US010504485B2

(12) United States Patent
Penttilä

(10) Patent No.: US 10,504,485 B2
(45) Date of Patent: Dec. 10, 2019

(54) DISPLAY MOTION QUALITY IMPROVEMENT

(75) Inventor: Jani Penttilä, Lempäälä (FI)

(73) Assignee: Nokia Tehnologies Oy, Espoo (FI)

( * ) Notice: Subject to any disclaimer, the term of this patent is extended or adjusted under 35 U.S.C. 154(b) by 468 days.

(21) Appl. No.: 13/332,717

(22) Filed: Dec. 21, 2011

(65) Prior Publication Data

US 2013/0162528 A1 Jun. 27, 2013

(51) Int. Cl.
*G09G 5/08* (2006.01)
*G09G 3/34* (2006.01)

(52) U.S. Cl.
CPC ..... *G09G 5/08* (2013.01); *G09G 3/342* (2013.01); *G09G 2310/024* (2013.01); *G09G 2320/0238* (2013.01); *G09G 2320/0252* (2013.01); *G09G 2320/106* (2013.01); *G09G 2330/021* (2013.01); *G09G 2354/00* (2013.01)

(58) Field of Classification Search
CPC ..... G09G 5/08; G09G 2330/021; G09G 2354/00; G09G 2320/0238; G09G 2320/0252; G09G 2310/024; G09G 2320/106; G09G 3/342
USPC ..... 345/157, 173–178
See application file for complete search history.

(56) References Cited

U.S. PATENT DOCUMENTS 7,535,463 B2 * 5/2009 Wilson ..... 345/175
7,653,883 B2 1/2010 Hotelling et al.
8,230,246 B1 * 7/2012 Sharkey ..... G06F 1/1626 713/320
8,259,208 B2 * 9/2012 Ciurea ..... G06F 3/0488 345/173
8,384,640 B2 * 2/2013 Wu ..... G09G 3/3648 345/204
2002/0158920 A1 * 10/2002 Abrams ..... G06F 3/04812 715/856
2005/0162566 A1 * 7/2005 Chuang ..... H04N 7/012 348/714
2007/0065040 A1 * 3/2007 Ming ..... G06F 1/1626 713/320
2008/0012835 A1 * 1/2008 Rimon et al. ..... 345/173
2008/0121442 A1 * 5/2008 Boer et al. ..... 178/18.09
2008/0231579 A1 * 9/2008 Vasquez ..... G09G 3/2092 345/98

(Continued)

FOREIGN PATENT DOCUMENTS

JP 2008104223 5/2008
JP 2009134508 6/2009
JP WO 2011104929 A1 * 9/2011 ..... G06F 3/0412

OTHER PUBLICATIONS

English Language Machine Translation of Japanese Patent Publication No. 2009134508, 16 pages.
English Language Abstract corresponding to Japanese Patent Publication No. 2009134508, 4 pages.
International Search Report for International Application No. PCT/FI2012/051246—Date of Completion of Search: Jul. 16, 2013, 5 pages.

(Continued)

*Primary Examiner* — Kent W Chang
*Assistant Examiner* — Joseph P Fox
(74) *Attorney, Agent, or Firm* — Locke Lord LLP

(57) ABSTRACT

An apparatus that includes a touch panel configured to receive user input, a display configured to show content, a motion quality improvement functionality for the display, at least one sensor configured to detect a pointing device approaching the apparatus, and a control unit configured to selectively activate the motion quality improvement functionality for the display in response to the detection of an approaching pointing device by the sensor.

18 Claims, 6 Drawing Sheets

(56) References Cited

U.S. PATENT DOCUMENTS

| | | | | |
|---|---|---|---|---|
| 2009/0254855 | A1 | 10/2009 | Kretz et al. | |
| 2009/0256814 | A1* | 10/2009 | Chung et al. | 345/173 |
| 2009/0303199 | A1 | 12/2009 | Cho et al. | |
| 2010/0026723 | A1 | 2/2010 | Nishihara et al. | |
| 2010/0231731 | A1 | 9/2010 | Motomura et al. | |
| 2010/0265280 | A1* | 10/2010 | Yen et al. | 345/691 |
| 2010/0289752 | A1 | 11/2010 | Birkler | |
| 2010/0300771 | A1* | 12/2010 | Miyazaki | 178/18.03 |
| 2011/0129164 | A1 | 6/2011 | Lin et al. | |
| 2011/0175832 | A1* | 7/2011 | Miyazawa et al. | 345/173 |
| 2011/0242037 | A1* | 10/2011 | Gruber | 345/173 |
| 2012/0071149 | A1* | 3/2012 | Bandyopadhyay | G06F 1/1643 455/418 |
| 2012/0287085 | A1* | 11/2012 | Yuki | G06F 3/0412 345/175 |

OTHER PUBLICATIONS

Written Opinion of the International Searching Authority for International Application No. PCT/FI2012/051246—Date of Completion of Opinion: Jul. 16, 2013, 7 pages.

Westerman, W., "Hand Tracking, Finger Identification, and Chordic Manipulation on a Multi-Touch Surface", Spring 1999, A dissertation submitted to the Faculty of the University of Delaware in partial fulfillment of the requirements for the degree of Doctor of Philosophy in Electrical Engineering, 363 pages.

Moghaddan, A. et al., "Integrating touch and near touch interactions for information visualizations", CHI 2011, May 7-12, 2011, Vancouver, BC, Canada, 6 pages.

* cited by examiner

DISPLAY MOTION QUALITY IMPROVEMENT

TECHNICAL FIELD

The present invention generally relates to display motion quality improvement. The invention relates particularly, though not exclusively, to motion quality enhancement or reduction of motion blur in displays of handheld or mobile devices.

BACKGROUND ART

In the field of television technology some methods have been introduced for improving motion quality (or motion blur removal) of Liquid Crystal Displays (LCD) or other display technologies. Due to different reasons the methods as such may not be optimal for use in displays of handheld or mobile devices.

SUMMARY

According to a first example aspect of the invention there is provided an apparatus comprising:

a touch panel configured to receive user input, a display configured to show content, a motion quality improvement functionality for the display, at least one sensor configured to detect a pointing device approaching the apparatus, and a control unit configured to selectively activate the motion quality improvement functionality for the display in response to the detection of an approaching pointing device by the at least one sensor.

According to a second example aspect of the invention there is provided a method comprising:

automatically detecting that a pointing device is approaching an apparatus that comprises a display, and selectively performing automatic activation of a motion quality improvement functionality for the display in response to the detection of the approaching pointing device.

According to a third example aspect of the invention there is provided a computer program embodied on a computer readable medium comprising computer executable program code which, when executed by at least one processor of an apparatus that comprises a display, causes the apparatus to:

detect that a pointing device is approaching the apparatus, and selectively perform activation of a motion quality improvement functionality for the display in response to the detection of the approaching pointing device Any foregoing memory medium may comprise a digital data storage such as a data disc or diskette, optical storage, magnetic storage, holographic storage, opto-magnetic storage, phase-change memory, resistive random access memory, magnetic random access memory, solid-electrolyte memory, ferroelectric random access memory, organic memory or polymer memory. The memory medium may be formed into a device without other substantial functions than storing memory or it may be formed as part of a device with other functions, including but not limited to a memory of a computer, a chip set, and a sub assembly of an electronic device.

Different non-binding example aspects and embodiments of the present invention have been illustrated in the foregoing. The above embodiments are used merely to explain selected aspects or steps that may be utilized in implementations of the present invention. Some embodiments may be presented only with reference to certain example aspects of the invention. It should be appreciated that corresponding embodiments may apply to other example aspects as well.

BRIEF DESCRIPTION OF THE DRAWINGS

The invention will be described, by way of example only, with reference to the accompanying drawings, in which.

DETAILED DESCRIPTION

Figure 1:
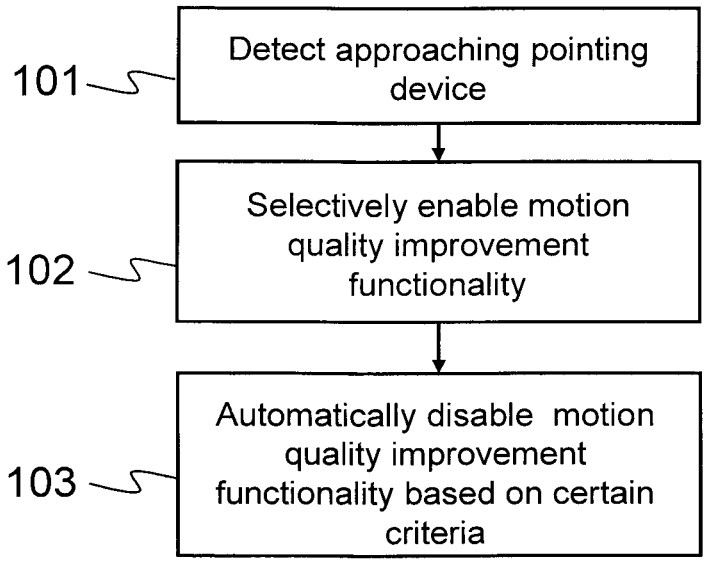
FIG. 1 shows a flow diagram of a method according to an example embodiment of the invention.

For example following methods can be used for motion quality improvement or reduction of motion blur in displays:

Black frame insertion (or backlight blinking)

Scanning backlight

Pixel overdrive.

In black frame insertion technology a black frame is inserted between image frames. This will improve black levels in the display. In this way human eye will perceive the image sharper. The insertion of the black frame can be accomplished for example by turning off and on the backlight of the display (backlight blinking).

Scanning backlight technology is similar to the black frame insertion technology but in scanning backlight technology only some parts of the backlight are turned off at a time while other parts remain on.

Pixel overdrive technology aims to improving pixel response time by applying an over-voltage to the pixels (the over-voltage makes the state transition in the pixels faster).

It must be noted that various embodiments of the invention are not restricted to use of these methods for motion quality improvement. Other motion quality improvement methods can be used as well.

In general the motion quality improvement mechanisms are such that if they are kept constantly on, there may be a considerable increase in power consumption. This is not desirable in handheld devices. For this reason, in some example implementations the motion quality improvement functionality is enabled only when it is likely that the functionality is needed. The challenge is to identify when this happens. As an example, the motion quality improvement functionality could be turned on when new content is shown on the display. A disadvantage is that bringing up the motion quality improvement functionality usually takes some time and therefore the user experience in the beginning may be deteriorated.

In an example embodiment of the invention it is detected that a pointing device is approaching a touch display, and a motion quality improvement functionality for the touch display is selectively turned on or enabled on the basis of or in response to this detection. In this way the motion quality improvement functionality can be turned on in advance, slightly before the functionality is needed.

In an example embodiment there is provided an apparatus that comprises a touch panel configured to receive user input, a display configured to show content, a motion quality improvement functionality for the display, at least one sensor configured to detect a pointing device approaching the apparatus, and a control unit configured to selectively activate the motion quality improvement functionality for the display in response to the detection of an approaching pointing device by the at least one sensor.

In an example embodiment of the invention the touch panel, the display and the at least one sensor are separate components that may be co-located (e.g. on top of each other) or placed in different locations in the apparatus. In an example embodiment of the invention the at least one sensor is integrated into the touch panel, but the display is a separate component that may be co-located with the touch panel (e.g. underneath the touch panel) or placed in a different location in the apparatus compared to the location of the touch panel. In an example embodiment of the invention the touch panel and the display are integrated into one combined touch display component, but the at least one sensor is a separate component that may be co-located with the touch display component or placed in a different location in the apparatus compared to the location of the touch display component. In an example embodiment of the invention the touch panel, the display and the at least one sensor are integrated into one combined touch display component.

In an example embodiment the approaching pointing device is detected by means of one or more sensors that are capable of detecting objects in vicinity of the display. The sensor may employ proximity sensing technology. While traditional, resistive, optical and capacitive touch sensor technologies are generally capable of sensing objects on zero or very close to the sensor, so called proximity sensors are capable of sensing objects that are further away, i.e. they can sense objects that are hovering in vicinity of the sensor. This can be accomplished for example by sensing the electrical field by a capacitive sensor. Additionally or alternatively, a camera of the apparatus can be used for the proximity detection. Accuracy of a proximity sensor can be relatively good when the distance between the sensor and the object nearby is in the scale of centimeters, for example.

Examples of pointing devices throughout this document include for example finger of a user of the apparatus, a stylus and other devices suitable for operating touch displays.

The approaching pointing device may be detected from such distance that it will take significant amount of time, e.g. several milliseconds or even seconds, for the pointing device to reach the display. In an example embodiment this time is used for bringing up the motion quality improvement functionality so that it is fully functional when the pointing device reaches the display. The pointing device may be detected e.g. when the distance between the display and the pointing device is 5-10 cm, but the distance could be even larger such as 10-50 cm or smaller such as 1-5 cm.

In an example embodiment the determination on whether to enable the motion quality improvement functionality or not is done on the basis of at least one of the following criteria:

arrival angle of the pointing device in relation to the surface of the display, the location of the of the pointing device in relation to the surface of the apparatus or the display, the location of the display the pointing device is likely to touch, the content shown on the display, the application the pointing device is likely to select or activate, the application that is currently active in the apparatus, a speed vector of the approaching pointing device, a direction vector of the approaching pointing device, a movement vector determined for the approaching pointing device, and the type of a control gesture the pointing device is likely to make (sweep, scroll, selection of an icon etc.).

In further example embodiments any combination of the criteria listed above is used for deciding whether to enable the motion quality improvement functionality or not. That is, in a given situation more than one criteria can be taken into account.

In an example embodiment one or more of the above listed criteria is used for determining whether to turn off the motion quality improvement functionality in case the motion quality improvement functionality is on.

In an example embodiment one or more of the above listed criteria is used additionally for determining suitable level for the motion quality improvement functionality in case the motion quality improvement functionality is to be turned on.

In an example embodiment the motion quality improvement functionality is turned on if an approaching pointing device is detected while an application that benefits from motion quality improvement functionality is active in the apparatus. There is not necessarily any need to use any other criteria for deciding about turning on the motion quality improvement functionality in this case. Clearly also some other criteria can be taken into account, too, though.

In an example embodiment the determination on which gesture the approaching pointing device is likely to make is done on the basis of speed or movement vector of the approaching pointing device. In an example, if there is a substantial vertical component in the speed vector, it is assumed that a somewhat aggressive touch (e.g. clicking, tapping or selecting an item) is to be expected. In an example, if there is not a significant vertical component in the speed vector or if there are both vertical and horizontal components in the speed vector, it is assumed that a soft touch (e.g. scrolling) is to be expected.

In an example embodiment, it is determined whether there is a horizontal (i.e. parallel to the surface of the display) speed component in movement vector of the approaching pointing device, and if there is, a sweeping or scrolling gesture is anticipated. In an example embodiment, it is determined whether there is an x and/or y component (z component being perpendicular to the display surface) in a speed vector of the approaching pointing device, and if there is, a sweeping or scrolling gesture is anticipated. If a sweeping or scrolling gesture is anticipated, the motion quality improvement functionality is turned on if some other criteria does not indicate that the motion quality improvement functionality is not needed or cannot be used.

More detailed examples of using the above listed criteria are discussed further below.

FIG. 1 shows a flow diagram of a method according to an example embodiment of the invention.

In phase 101, it is detected that a pointing device, such as user's finger or stylus, is approaching a touch display. In an example, a proximity sensing function is used for this detection. The detection of the approaching pointing device is performed automatically by an apparatus performing the method and more specifically e.g. by a proximity sensor in the apparatus.

In phase 102, a motion quality improvement functionality is selectively enabled for the display in response to the detection of the approaching pointing device. The enabling of the motion quality improvement functionality is performed automatically for example in the control of a suitable computer program code. In an example, enabling the motion quality improvement functionality depends on at least one of the different criteria listed above.

In phase 103, the motion quality improvement functionality is automatically turned off (or disabled) on the basis of certain criteria. In an example the motion quality improvement functionality is automatically turned off after certain period of time without any new content being shown on the display. Also some other criteria may apply.

Figure 2A:
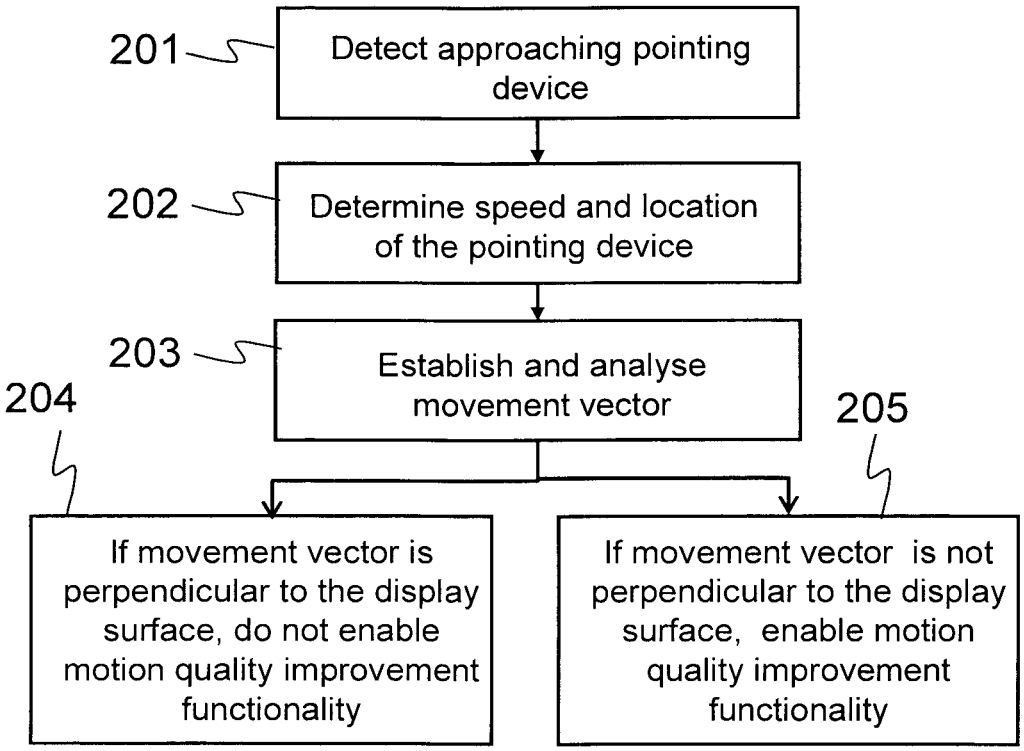
FIG. 2A shows a flow diagram of a method according to another example embodiment of the invention.

FIG. 2A shows a flow diagram of a method according to another example embodiment of the invention.

In this example embodiment the motion quality improvement functionality is not turned on if the pointing device approaches the display substantially perpendicularly (i.e. perpendicularly or almost perpendicularly), that is, enabling the motion quality improvement functionality is avoided or prevented. In this case it is assumed that it is likely that the user is about to select an icon or tap an item on the screen (e.g. a link on a web page) and therefore the motion quality improvement functionality is not necessarily needed.

The motion quality improvement functionality is turned on if the pointing device does not approach the display substantially perpendicularly, that is, if the pointing device approaches the display in certain angle. In this case it is assumed that it is likely that the user is about to scroll content on the screen (e.g. a content on a web page or content of a list, such as phone book, or song list in a music player) and therefore the motion quality improvement functionality is likely needed.

In phase 201, it is detected that a pointing device, such as user's finger or stylus, is approaching a touch display. In an example, a proximity sensing function is used for this detection.

In phase 202, speed and location of the approaching pointing device are determined, and in phase 203, movement vector of the approaching pointing device is established and analysed. On the basis of the analysis of the movement vector the procedure proceeds to phase 204 or 205.

If the movement vector is perpendicular to or at least almost perpendicular to the surface of the display, a motion quality improvement functionality is not enabled in phase 204. If the movement vector is not perpendicular to or almost perpendicular to the surface of the display, the motion quality improvement functionality is enabled in phase 205. In a later phase the motion quality improvement functionality is disabled again on the basis of some criteria (e.g. in response to determining that the motion quality improvement functionality is not needed anymore).

Figure 2B:
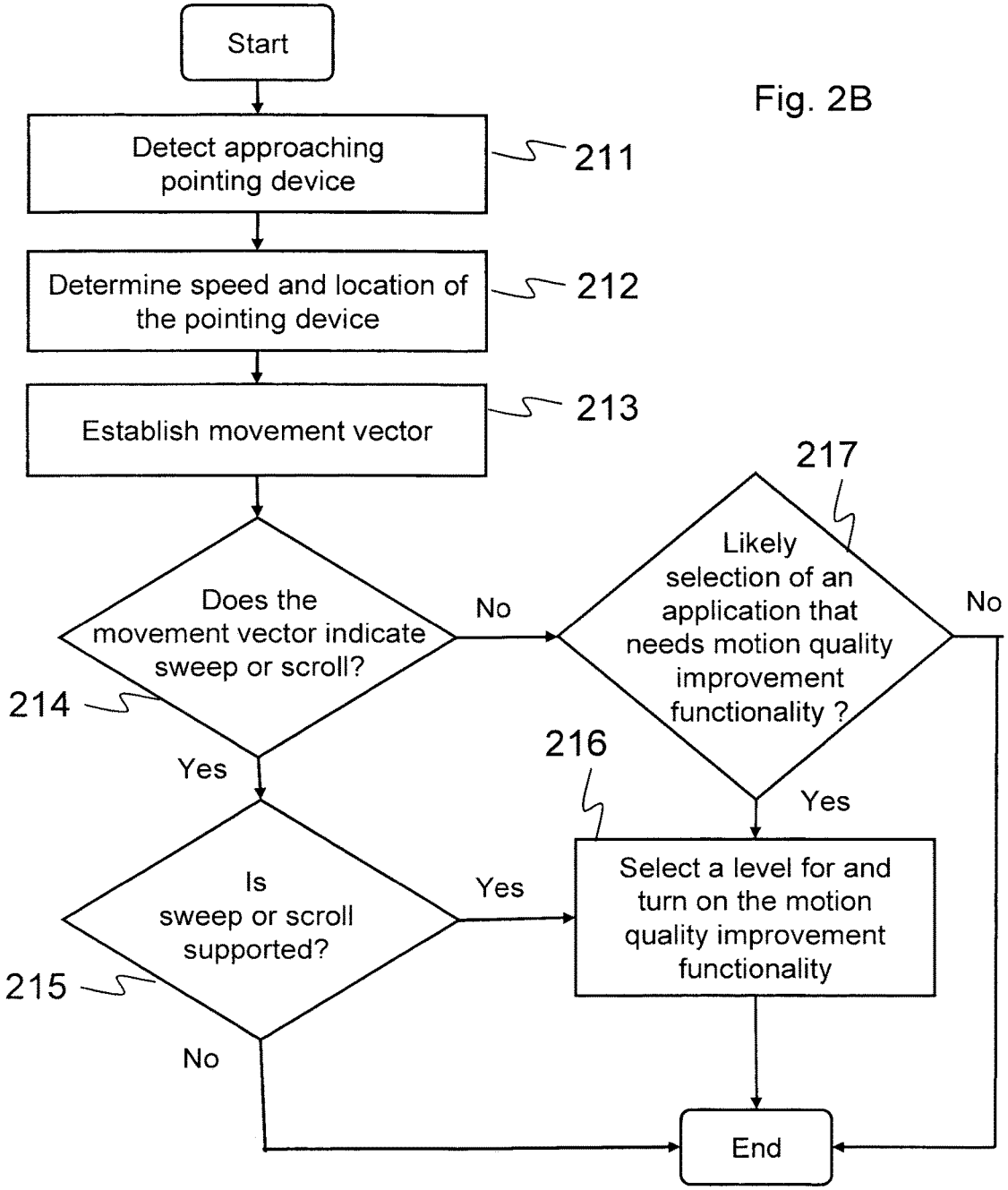
FIG. 2B shows a flow diagram of a method according to yet another example embodiment of the invention.

FIG. 2B shows a flow diagram of a method according to yet another example embodiment of the invention.

In this example embodiment the application that the approaching pointing device is likely to select or the application that is currently active in the apparatus is taken into account in addition to the arrival angle and/or arrival speed. Even if it is determined that the pointing device is approaching the display substantially perpendicularly, the motion quality improvement functionality will be turned on, if the application that is most likely selected is such that it would benefit from the motion quality improvement functionality. For example, if the location of the pointing device is such that a selection of a game or a video icon can be anticipated, the motion quality improvement functionality is turned on. Likewise, if the application that is most likely selected is such that it does not need the motion quality improvement functionality, the motion quality improvement functionality is not turned on.

The application that is most likely selected by the pointing device can be determined on the basis of the location of the pointing device in relation to the display (i.e. the location that the pointing device is likely to touch on the display) and the content (e.g. icons) shown on the display.

Additionally or alternatively, if the application that is active (currently on) in the apparatus, when an approaching pointing device is detected, is an application that benefits from the motion quality improvement functionality, the motion quality improvement functionality can be turned on irrespective of the arrival angle and/or speed of the approaching pointing device. Whereas, even if the application that is currently on in the apparatus is an application that benefits from the motion quality improvement functionality, the motion quality improvement functionality is not turned on (or is turned off, if it is currently on) if an approaching pointing device has not been detected and the content on the display is not changing (e.g. scrolling or sweeping content has stopped). In this way the motion quality improvement functionality is turned on only when it is needed and if it is detected that the motion quality improvement functionality is not needed anymore, it is turned off.

Still further, the arrival speed can be used for determining suitable level for the motion quality improvement functionality in case the motion quality improvement functionality is to be turned on.

In phase 211, it is detected that a pointing device, such as user's finger or stylus, is approaching a touch display. In an example, a proximity sensing function is used for this detection.

In phase 212, speed and location of the approaching pointing device are determined, and in phase 213, movement vector of the approaching pointing device is established.

In phase 214 it is checked if the movement vector indicates sweeping or scrolling gesture. If sweeping or scrolling is indicated, it is checked in phase 215 whether the currently active application supports sweeping or scrolling. If sweeping or scrolling is not supported the process stops and motion quality improvement functionality is not turned on.

If sweeping or scrolling is not indicated in phase 214, the process proceeds to phase 217 and checks if it is likely that an application that needs (or benefits from) motion quality improvement functionality is selected by the pointing device. If this is not likely that an application that needs motion quality improvement functionality is selected (e.g. if it is likely that an application that does not need or benefit from motion quality improvement functionality is selected) the process stops and motion quality improvement functionality is not turned on.

If it is concluded in phase 215 that sweeping or scrolling is supported or in phase 217 that it is likely that an application that needs motion quality improvement functionality is selected, the process proceeds to phase 216. In phase 216 a suitable level is selected for the motion quality improvement functionality and the motion quality improvement functionality is turned on. After this the process stops.

In an example embodiment, the suitable level of the motion quality improvement functionality is determined based on speeds and directions of the pointing device versus the surface of the display. E.g. if a combined speed and direction vector of the pointing device indicates a slow movement above the surface of the display then e.g. scrolling of content displayed on the display is also slow, whereby the level of the motion quality improvement functionality can be slow and vice versa, fast movement requires fast motion quality improvement functionality.

In a more general example embodiment, the level of the motion quality improvement functionality is controlled in response to the detection of an approaching pointing device. For example, if the motion quality improvement functionality is already on, when an approaching pointing device is detected, the level of the motion quality improvement functionality can be changed on the basis of the approaching pointing device. The motion quality improvement functionality can be made faster or slower for example.

Figure 2C:
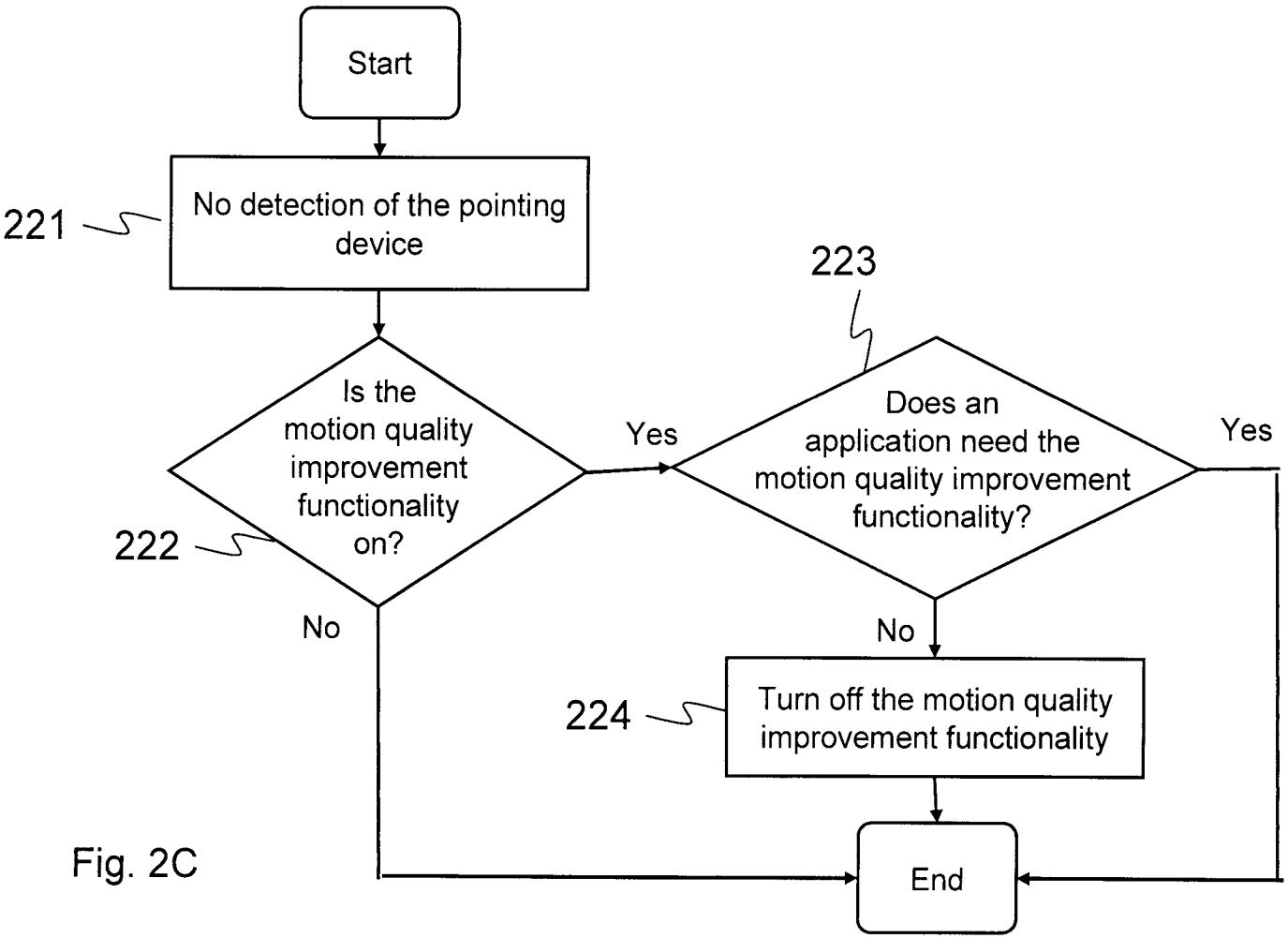
FIG. 2C shows a flow diagram of a method according to still another example embodiment of the invention.

FIG. 2C shows a flow diagram of a method according to still another example embodiment of the invention.

In this example embodiment the motion quality improvement functionality is turned off if it is not needed. This method may be performed for example periodically or the method may be triggered on the basis of some other criteria.

In phase 221, the process is in a state in which there is no detection of an approaching pointing device. Then in phase 222, it is checked if the motion quality improvement functionality is on or not. If the motion quality improvement functionality is not on the process stops. I.e. in this case there is no need to take any action.

If the motion quality improvement functionality is on, it is checked in phase 223 whether the motion quality improvement functionality is needed, e.g. whether the currently active application needs the motion quality improvement functionality. If the motion quality improvement functionality is not needed it is turned off in phase 224. E.g. if content on the display is not changing, it may be determined that the motion quality improvement functionality is not needed. If the motion quality improvement functionality is needed, e.g. if there is changing content on the display, the process stops. I.e. in this case there is no need to take any action.

The methods of FIGS. 1 and 2A-2C may be performed in the apparatuses and devices shown in FIGS. 3-7.

Figure 3:
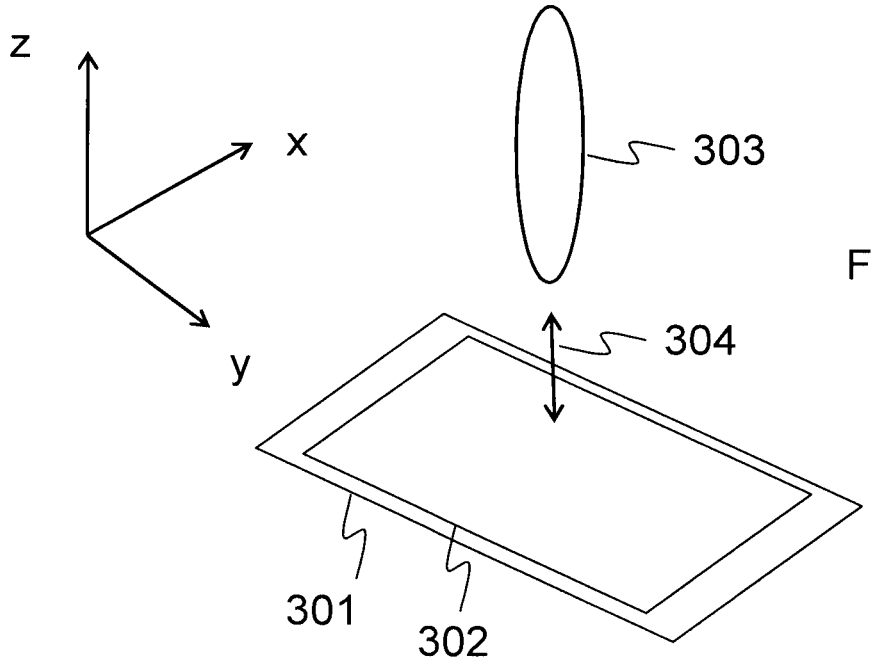
FIG. 3 shows a scenario according to an example embodiment of the invention.
Figure 4:
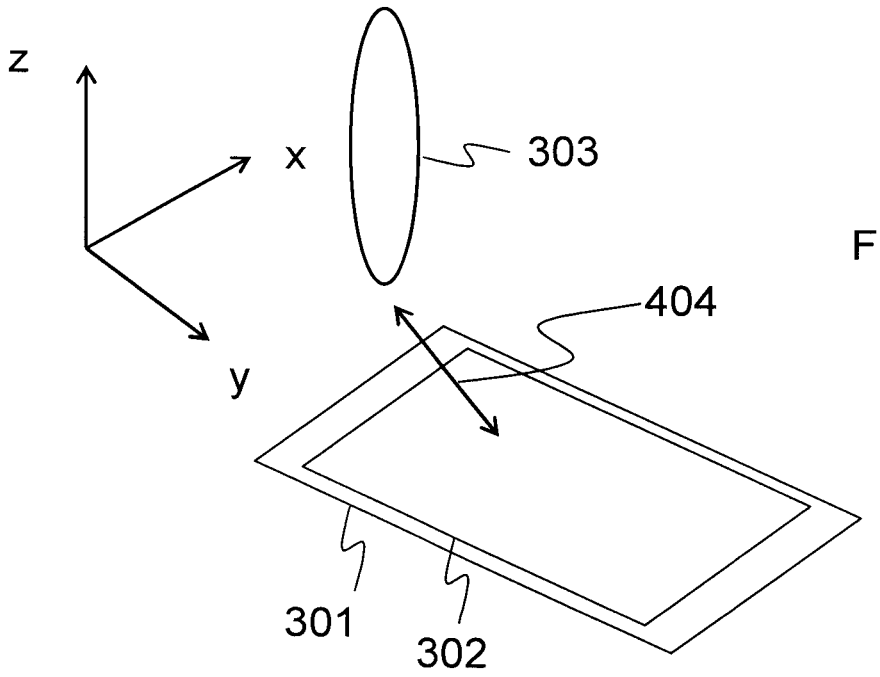
FIG. 4 shows a scenario according to another example embodiment of the invention

FIGS. 3 and 4 show scenarios according to example embodiments of the invention. The scenarios in both FIGS. 3 and 4 comprise a pointing device 303 and an apparatus 301 that comprises a display 302. The pointing device 303 is approaching the display 302 of the apparatus 301.

In scenario of FIG. 3 an arrow 304 illustrates arrival direction of the pointing device. The arrow 304 shows that the pointing device 303 is approaching the display 302 substantially perpendicularly in relation to the display surface 302. In an example the perpendicular arrival direction is determined on the basis of that a movement vector of the approaching pointing device 303 comprises a significant z component and insignificant x and y components.

In scenario of FIG. 4 an arrow 404 illustrates arrival direction of the pointing device. The arrow 404 shows that the pointing device 303 is approaching the display 302 substantially diagonally in relation to the display surface 302. In an example it is determined that the arrival direction is inclined in relation to the display surface 302 on the basis of that a movement vector of the approaching pointing device 303 comprises x and/or y components in addition to or instead of z component.

Figure 5:
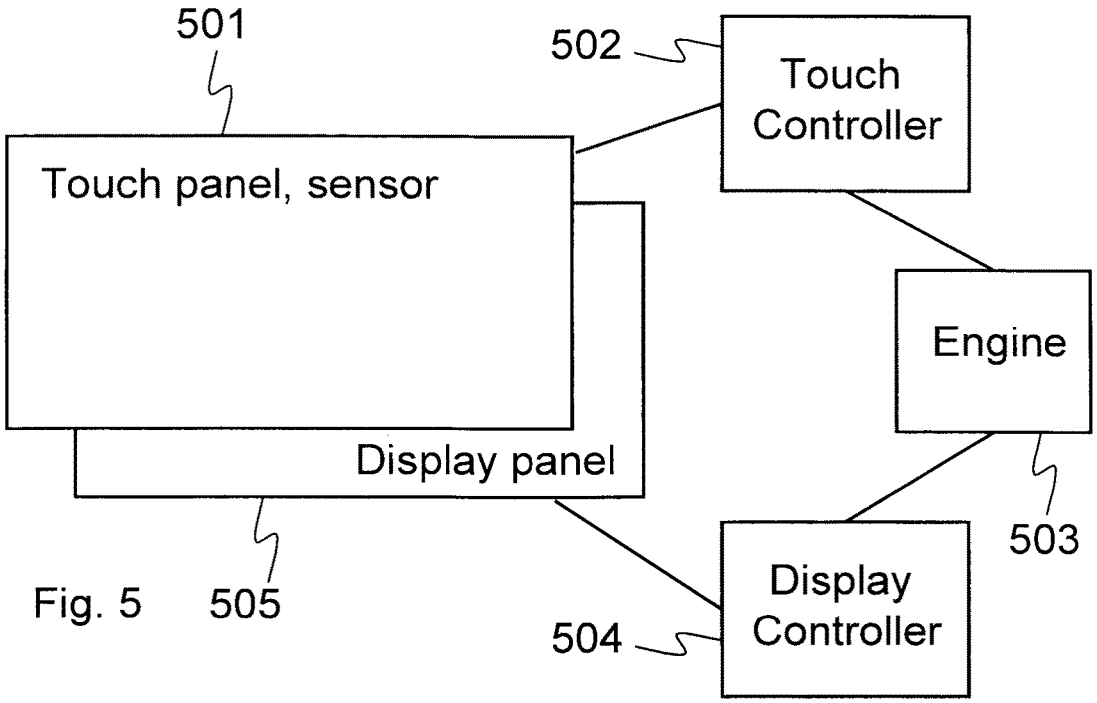
FIG. 5 shows a block diagram of an apparatus according to an example embodiment of the invention.
Figure 6:
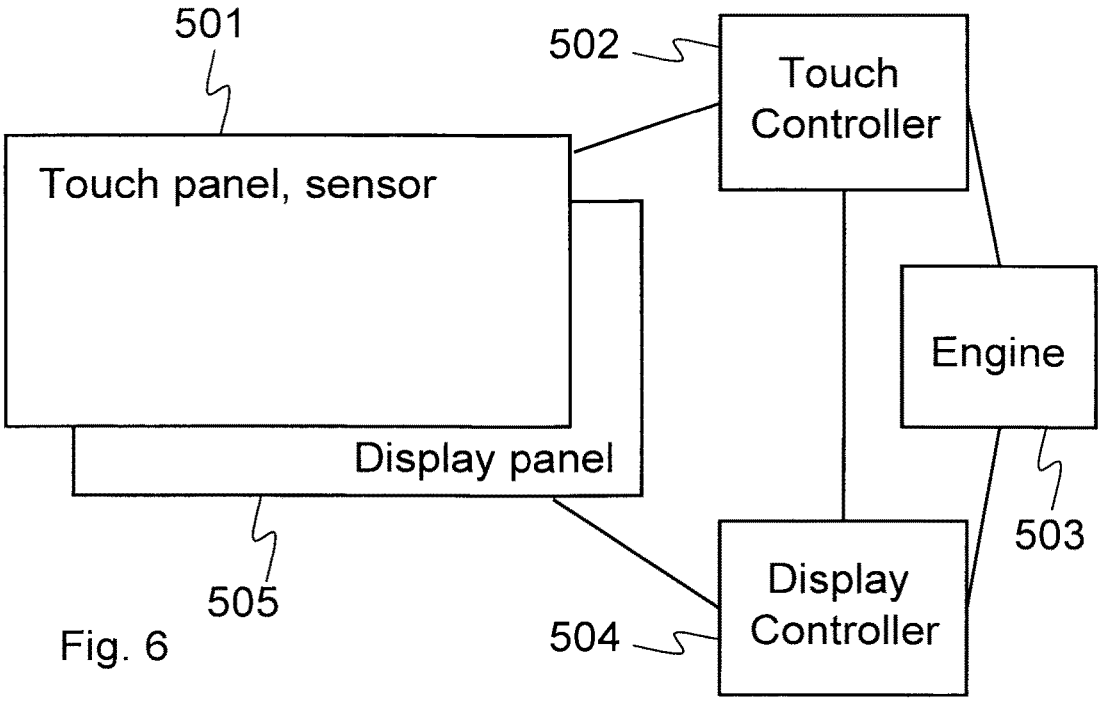
FIG. 6 shows a block diagram of an apparatus according to another example embodiment of the invention.
Figure 7:
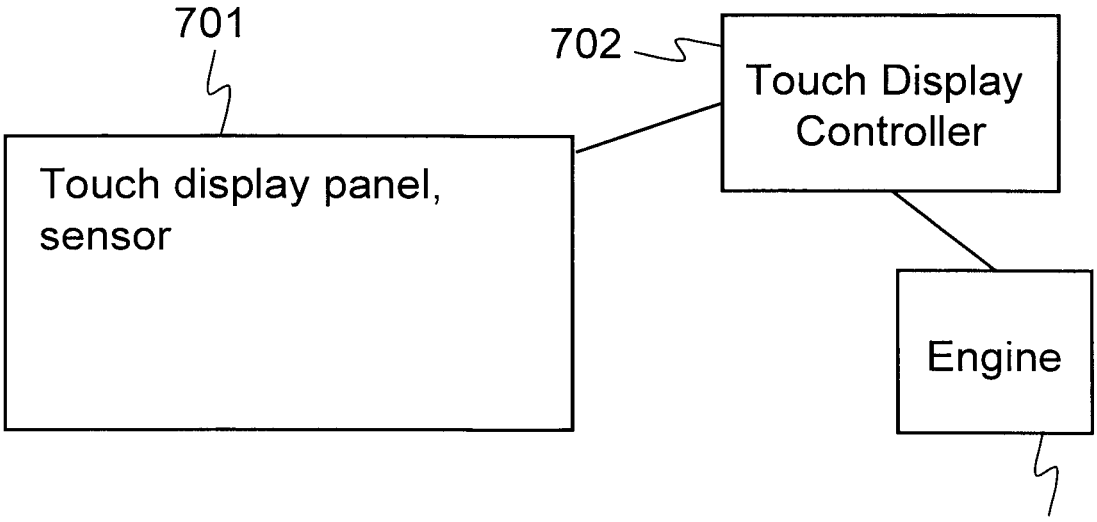
FIG. 7 shows a block diagram of an apparatus according to yet another example embodiment of the invention.

FIGS. 5-7 show block diagrams of apparatuses according to example embodiments of the invention. Various embodiments of the invention may be applied in these apparatuses. The apparatuses may be for example mobile phones or other handheld electronic devices.

The general structure of the apparatus of FIG. 5 comprises a touch panel 501 comprising a sensor capable of detecting objects in proximity of the panel 501 e.g. by using proximity sensing technology, a touch controller unit 502 configured to control the touch panel 501, a display panel 505, and a display controller unit 504 configured to control the display panel 505. The touch panel 501 may be for example a touch-sensitive surface. The display panel 505 may be for example a liquid crystal display (LCD) or an organic light-emitting diode (OLED) based display. In an example the touch panel 501 is placed on top of the display panel 505 to form a touch display. The touch panel 501 and the display panel 504 may be separate components or included in one component integrating the functionality of both panels 501 and 505. The touch panel 501 may also be included as a separate element, for example as a touchpad.

Additionally the apparatus of FIG. 5 comprises an engine unit 503 configured to communicate with the touch controller 502 and the display controller 504. In an example the engine unit 503 controls operation of the apparatus as whole. The engine unit 503 includes one or more processors. The processor may be, e.g., a central processing unit (CPU), a microprocessor, a digital signal processor (DSP), a graphics processing unit, or the like. The engine 503 further comprises software stored in a memory and operable to be loaded into and executed in the processor.

In some embodiments, the software comprises one or more software modules and can be in the form of a computer program product.

In an example embodiment of the invention the apparatus of FIG. 5 operates as follows:

- The sensor in the touch panel 501 detects an approaching pointing device and a signal indicating this event is sent to the touch controller 502 and the touch controller 502 conveys the event to the engine 503. In an example, the event comprises information about the distance between the pointing device and the touch panel 501, location of the pointing device in relation to the touch panel 501, speed of the pointing device and/or arrival angle of the pointing device in relation to the touch panel 501.
- A software in the engine unit 503 analyses the event received from the touch controller 502 and decides on the basis of the event whether to enable motion quality improvement functionality or not. The decision logic that may be applied has been discussed above in connection with other embodiments.
- If it is decided that the motion quality improvement functionality will be enabled, the engine 503 sends to the display controller 504 instructions to turn on the motion quality improvement functionality. The display controller 504 then controls the display panel 505 accordingly.

The general structure of the apparatus of FIG. 6 is similar to the structure shown in FIG. 5, but the functionality included in the touch controller 502, display controller 504 and the engine unit 503 is different at least to some extent. In this embodiment the touch controller 502 is directly connected to the display controller 504.

In an example embodiment of the invention the apparatus of FIG. 6 operates as follows:

The sensor in the touch panel 501 detects an approaching pointing device and a signal indicating this event is sent to the touch controller 502. In an example, the event comprises information about the distance between the pointing device and the touch panel 501, location of the pointing device in relation to the touch panel 501, speed of the pointing device and/or arrival angle of the pointing device in relation to the touch panel 501.

The touch controller 502 is configured to analyze the event received from the sensor in the touch panel 501 and decides on the basis of the event whether to enable motion quality improvement functionality or not. There may be for example a software performing this analysis in the touch controller 502. The decision logic that may be applied has been discussed above in connection with other embodiments.

If it is decided that the motion quality improvement functionality will be enabled, the touch controller 502 sends to the display controller 504 instructions to turn on the motion quality improvement functionality. The display controller 504 then controls the display panel 505 accordingly.

The general structure of the apparatus of FIG. 7 comprises a touch display panel 701 comprising a sensor capable of detecting objects in proximity of the panel 701 e.g. by using proximity sensing technology, a touch display controller unit 702 configured to control the touch display panel 701. The touch display panel 701 is an integrated touch surface and display panel (e.g. an LCD or OLED based display). In an example the touch display panel 701 comprises touch panel sensing matrix that is integrated on a display panel. The touch display controller 702 is configured to receive input through the touch display panel 701 and to control content that is displayed on the panel 701, for example. The touch display panel 701 can be called a combined display and touch panel or combined display and touch controller.

Additionally the apparatus of FIG. 7 comprises an engine unit 703 configured to communicate with the touch display controller 702. In an example the engine unit 703 controls operation of the apparatus as whole. The engine unit 703 includes one or more processors. The processor may be, e.g., a central processing unit (CPU), a microprocessor, a digital signal processor (DSP), a graphics processing unit, or the like. The engine 703 further comprises software stored in a memory and operable to be loaded into and executed in the processor. In some embodiments, the software comprises one or more software modules and can be in the form of a computer program product.

In an example embodiment of the invention the apparatus of FIG. 7 operates as follows:

The sensor in the touch display panel 701 detects an approaching pointing device and a signal indicating this event is sent to the touch display controller 702. In an example, the event comprises information about the distance between the pointing device and the touch display panel 701, location of the pointing device in relation to the touch display panel 701, speed of the pointing device and/or arrival angle of the pointing device in relation to the touch display panel 701.

The touch display controller 702 is configured to analyze the event received from the sensor in the touch display panel 701 and decides on the basis of the event whether to enable motion quality improvement functionality or not. There may be for example a software performing this analysis in the touch display controller 702. The decision logic that may be applied has been discussed above in connection with other embodiments.

If it is decided that the motion quality improvement functionality will be enabled, the touch display controller 702 turns on the motion quality improvement functionality and controls the touch display panel 701 accordingly.

In the examples shown in FIGS. 5-7, the sensor that is configured to detect the approaching pointing device is part of the touch panel. It must be noted that this sensor could be a separate component, too. In an example embodiment there are separate sensors for detecting objects near by the apparatus and for normal touch detection for the touch panel. In an example, a sensor employing IR LED (infra red light emitting diode) technology is used for sensing objects in vicinity of the apparatus, i.e. hovering objects, and another sensor employing some other sensor technology, e.g. resistive, optical, or capacitive touch sensor technology, is used for detecting objects that touch the touch panel. Clearly this is only one example and also other sensor technologies can be used.

A skilled person appreciates that in addition to the elements shown in FIGS. 5-7, in some embodiments the shown apparatuses comprise other elements, such as communication interface modules (e.g. e.g., a radio interface module, such as a WLAN, Bluetooth, GSM/GPRS, CDMA, WCDMA, or LTE (Long Term Evolution) radio module), microphones, extra displays, as well as additional circuitry such as input/output (I/O) circuitry, memory chips, application-specific integrated circuits (ASIC), processing circuitry for specific purposes such as source coding/decoding circuitry, channel coding/decoding circuitry, ciphering/deciphering circuitry, and the like. Additionally, the apparatuses may comprise a disposable or rechargeable battery (not shown) for powering the apparatus when external power if external power supply is not available.

It must be noted that further alternative embodiments may comprise any suitable combination of different features of FIGS. 5-7.

Without in any way limiting the scope, interpretation, or application of the claims appearing below, a technical effect of one or more of the example embodiments disclosed herein is that it may be possible to reduce motion blur in displays of handheld devices thereby improving user experience.

Another technical effect is that is that the need for motion quality improvement functionality can be anticipated before an actual selection of an application (e.g. game, video application) or operation (e.g. sweeping, scrolling) needing the motion quality improvement functionality. That is, it is possible to enable the motion quality improvement functionality in advance so that it is fully functional when it is actually needed.

Yet another technical effect is that it may be possible to reduce motion blur without substantially increasing power consumption which suits well for use in handheld and other battery powered devices.

Various embodiments have been presented. It should be appreciated that in this document, words comprise, include and contain are each used as open-ended expressions with no intended exclusivity.

In the present disclosure the expression at least one is used in connection with some structures or features. This simply means that the is one, two or more of those structures. Some other structures may be disclosed without expressly defining the there is at least one such structure. Nevertheless it is clear that there may be more than one of those structures or features, too. The intention is to limit to having only of piece of certain feature only if it is expressly defined that there is only one piece of that structure and it is not possible to have more than one piece of that structure. For example, a solution according to an embodiment of the invention may comprise more than one sensor and/or more than one display and/or more than one control unit or processor etc.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented above, but that it can be implemented in other embodiments using equivalent means or in different combinations of embodiments without deviating from the characteristics of the invention.

Furthermore, some of the features of the above-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. An apparatus comprising:

a touch panel configured to receive user input, a display configured to show content, at least one sensor configured to detect a pointing device approaching the apparatus, and a control unit configured to selectively instruct activation of a motion quality improvement functionality for the display in response to detection of an approaching pointing device by the at least one sensor and prior to the approaching pointing device touching the touch panel and prior to a moving image being displayed on the display, wherein the motion quality improvement functionality is a functionality to reduce blur on the moving image when the moving image is displayed on the display, wherein the motion quality improvement functionality is initially in a disabled state and the activation of the motion quality improvement functionality comprises bringing up the motion quality improvement functionality, and wherein the control unit is configured to decide whether to activate the motion quality improvement functionality at least on the basis of an application that the approaching pointing device is likely to select and whether said application is likely to need the motion quality improvement functionality because said application is configured to provide a moving image that may blur when displayed on the display.

2. An apparatus of claim 1, wherein the at least one sensor employs proximity sensing technology.

3. An apparatus of claim 1, wherein the touch panel and the display are part of an integrated touch display.

4. An apparatus of claim 1, wherein the at least one sensor is part of the touch panel.

5. An apparatus of claim 1, wherein the at least one sensor and the touch panel are separate components.

6. An apparatus of claim 1, wherein the at least one sensor is configured to detect a movement vector with which the pointing device is approaching the apparatus, and the control unit is configured to decide whether to activate the motion quality improvement functionality at least on the basis of the movement vector.

7. An apparatus of claim 1, wherein the at least one sensor is configured to detect an arrival angle with which the pointing device is approaching the apparatus, and the control unit is configured to decide whether to activate the motion quality improvement functionality at least on the basis of the arrival angle.

8. An apparatus of claim 1, wherein the control unit is configured to determine the gesture the pointing device is likely to make and to decide whether to activate the motion quality improvement functionality at least on the basis of the determined gesture.

9. An apparatus of claim 1, wherein the control unit is configured to decide whether to activate the motion quality improvement functionality at least on the basis of location of the approaching pointing device and the content shown on the display.

10. An apparatus of claim 1, wherein the control unit is configured to decide whether to activate the motion quality improvement functionality at least on the basis of an application that is currently active in the apparatus.

11. An apparatus of claim 1, wherein the control unit is configured to control level of the motion quality improvement functionality in response to the detection of an approaching pointing device and based on speeds and directions of the approaching pointing device versus the touch panel.

12. An apparatus according to claim 1, wherein motion quality improvement functionality is configured to use at least one of: black frame insertion, backlight blinking, scanning backlight, and pixel overdrive.

13. An apparatus of claim 1, wherein the selectively instructing of activation of the motion quality improvement functionality provides that keeping the motion quality improvement functionality constantly on is avoided to reduce power consumption.

14. An apparatus of claim 1, wherein the selectively instructing of activation of the motion quality improvement functionality provides that the motion quality improvement functionality is fully operational when the pointing device reaches the display.

15. An apparatus of claim 1, wherein the selectively instructing of activation of the motion quality improvement functionality comprises deciding on the basis of the detection of the approaching pointing device whether to activate the motion quality improvement functionality or not.

16. An apparatus of claim 1, wherein the motion quality improvement functionality is selectively disabled.

17. A method comprising:

automatically detecting that a pointing device is approaching an apparatus that comprises a display, and selectively performing automatic activation of a motion quality improvement functionality for the display in response to the detection of the approaching pointing device, wherein the motion quality improvement functionality is configured to reduce blur on a moving image on the display, wherein the motion quality improvement functionality is activated prior to the approaching pointing device touching the display and prior to the moving image being displayed on the display, wherein the motion quality improvement functionality is initially in a disabled state and the activation of the motion quality improvement functionality comprises bringing up the motion quality improvement functionality, and wherein the motion quality improvement functionality is activated at least on the basis of an application that the approaching pointing device is likely to select and whether said application is likely to need the motion quality improvement functionality because said application is configured to provide a moving image that may blur when displayed on the display.

18. A computer program product comprising a non-transitory computer readable medium having computer executable program code embodied thereon which, when executed by at least one processor of an apparatus that comprises a display, causes the apparatus to:

detect that a pointing device is approaching the apparatus, and selectively perform activation of a motion quality improvement functionality for the display in response to the detection of the approaching pointing device, wherein the motion quality improvement functionality is configured to reduce blur on a moving image on the display, wherein the motion quality improvement functionality is activated prior to the approaching pointing device touching the display and prior o the moving image being displayed on the display, wherein the motion quality improvement functionality is initially in a disabled state and the activation of the motion quality improvement functionality comprises bringing up the motion quality improvement functionality, and wherein the motion quality improvement functionality is activated at least on the basis of an application that the approaching pointing device is likely to select and whether said application is likely to need the motion quality improvement functionality because said application is configured to provide a moving image that may blur when displayed on the display.

* * * * *